US008479702B2

(12) United States Patent
Adachi et al.

(10) Patent No.: US 8,479,702 B2
(45) Date of Patent: Jul. 9, 2013

(54) SMALL-SIZED VEHICLE

(75) Inventors: Ken Adachi, Wako (JP); Masahiro Nakashima, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 463 days.

(21) Appl. No.: 12/767,097

(22) Filed: Apr. 26, 2010

(65) Prior Publication Data

US 2010/0300795 A1 Dec. 2, 2010

(30) Foreign Application Priority Data

May 28, 2009 (JP) ..... 2009-128738

(51) Int. Cl.
*F01M 1/02* (2006.01)

(52) U.S. Cl.
USPC ..... 123/196 R; 123/90.63

(58) Field of Classification Search
USPC ..... 123/90.12, 90.21, 90.31, 90.39, 90.63, 123/196 R
See application file for complete search history.

(56) References Cited

U.S. PATENT DOCUMENTS 4,678,223 A * 7/1987 Kishi et al. ..... 296/78.1
6,318,316 B1 11/2001 Tsukui et al.
7,308,882 B2 * 12/2007 Suzuki et al. ..... 123/196 CP
2008/0236522 A1 * 10/2008 Maehara et al. ..... 123/54.4

FOREIGN PATENT DOCUMENTS

JP 2000-205038 A 7/2000
JP 2005-330857 A 12/2005

* cited by examiner

*Primary Examiner* — Noah Kamen
*Assistant Examiner* — Hung Q Nguyen
(74) *Attorney, Agent, or Firm* — Westerman, Hattori, Daniels & Adrian, LLP

(57) ABSTRACT

A small-sized vehicle has an oil control valve for a hydraulically-actuated mechanism of an engine, and provides good cooling of the oil control valve. A small-sized vehicle includes a spool valve for adjusting a hydraulic pressure for a hydraulically-actuated mechanism of an engine. The spool valve is disposed sideways of a cylinder portion (cylinder head) such that an axis of the spool valve extends substantially in parallel with an axis of the cylinder portion. Further, the spool valve is disposed at a position that is rearward of a radiator and that falls within a vertical span of the radiator in a vehicle side view.

8 Claims, 17 Drawing Sheets

SMALL-SIZED VEHICLE

TECHNICAL FIELD

The present invention relates to small-sized vehicles, such as motorcycles having an oil control valve for adjusting a hydraulic pressure of a valve actuating mechanism or other hydraulically actuated mechanisms.

BACKGROUND OF THE INVENTION

A known arrangement in the small-sized vehicle includes an oil control valve disposed rearwardly of a cylinder that stands upright in a condition of being mounted on the vehicle or a cylinder head (see, for example, Japanese Patent Laid-open Nos. 2000-205038 and 2005-330857).

SUMMARY OF THE INVENTION

There is, however, room for improvement in the known arrangement mentioned above on cooling performance of the oil control valve, because the oil control valve is susceptible to heat from the cylinder and cooling by an air flow cannot be expected to cool the heat generated by the valve itself.

The small-sized vehicle having an oil control valve for a hydraulically-actuated mechanism of an engine achieves good cooling of the oil control valve.

According to a first aspect of the vehicle, there is provided a small-sized vehicle (for example, a motorcycle 101, 101', or 101" of the preferred embodiments) that includes: an engine (for example, an engine 1 or 1" of preferred embodiments) having a cylinder (for example, a cylinder main body 30*a* of the preferred embodiments) that stands upright in a condition of being mounted on the vehicle; a radiator (for example, a radiator 115 of the preferred embodiments) disposed adjacent to the engine on a forward side of the vehicle, and; an oil control valve (for example, a spool valve 81 of the preferred embodiments) for adjusting a hydraulic pressure for a hydraulically-actuated mechanism (for example, a variable valve actuating mechanism 5 of the preferred embodiments) of the engine. In this small-sized vehicle, the oil control valve is disposed sideways of the cylinder or a cylinder head (for example, a cylinder head 2 of the preferred embodiments) such that an axis (for example, an axis C8 of the preferred embodiments) of the oil control valve extends substantially in parallel with an axis (for example, an axis C2 of the preferred embodiments) of the cylinder. Further, the oil control valve is disposed at a position that is rearward of the radiator and that falls within a vertical span of the radiator in a vehicle side view.

According to the second aspect of the vehicle, the oil control valve is disposed sideways of the cylinder or the cylinder head and between the engine and the radiator.

According to the third aspect of the vehicle, the oil control valve is disposed such that at least part of the oil control valve bulges outwardly of the radiator in the vehicle width direction in a vehicle front view.

According to the fourth aspect of the vehicle, the small-sized vehicle further includes a cover member (for example, a radiator cover 121 or a cowling 122 of the preferred embodiments) which extends from a side of the radiator to a side of the engine. In this small-sized vehicle, an air flow path (for example, an air flow path K1 or K2 of the preferred embodiments) is formed inside the cover member and the oil control valve is disposed inside the cover member.

According to the firth aspect of the vehicle, the small-sized vehicle further includes a down frame (for example, a down frame 112 of the preferred embodiments) that extends vertically at a portion to the side of the cylinder, in the vehicle width direction, to support the engine. In this small-sized vehicle, at least part of the oil control valve is disposed between the down frame and the radiator in a vehicle side view.

According to the first aspect of the vehicle, the oil control valve is disposed to the side of the cylinder or the cylinder head that stands upright on the engine. This makes an air flow from a vehicle forward direction tend more easily to blow against the oil control valve without being blocked by the cylinder. Additionally, the arrangement in which the oil control valve is disposed at the position that is rearward of the radiator and that falls within the vertical span of the radiator in the vehicle side view allows the oil control valve to be disposed at a position through which the air flow is generally easy to flow. By actively exposing the oil control valve to the air flow in the manner as described above, cooling efficiency of the oil control valve is enhanced, so that effect of heat from the cylinder and from that generated by the valve can be inhibited. Further, the axis of the oil control valve is arranged to extend along the axis of the cylinder, which inhibits the oil control valve from bulging outwardly of the cylinder. This enhances the degree of freedom in disposing the oil control valve.

According to the second aspect of the vehicle, the oil control valve is disposed close to the radiator. This allows the air flow to be even more actively blown against the oil control valve. This, in turn, further enhances the cooling efficiency of the oil control valve.

According to the third aspect of the vehicle, at least part of the oil control valve bulges outwardly of the radiator. This allows an air flowing along left and right sides of the radiator to be blown against the oil control valve, so that the cooling efficiency of the oil control valve can be further enhanced.

According to the fourth aspect of the vehicle, the oil control valve is disposed inside the cover member inside which the air flow path is formed. The oil control valve can therefore be exposed to the air that flows inside the cover member, so that the cooling efficiency of the oil control valve can be further enhanced.

According to the fifth aspect of the vehicle, a portion of the oil control valve, such as a driving portion thereof, is disposed between the down frame and the radiator in the vehicle side view. By using an unused space formed between the down frame and the radiator, the driving portion of the oil control valve that tends to be bulky on the vehicle outside can therefore be disposed, thereby circumventing the down frame and the radiator. The vehicle width around the oil control valve can therefore be kept small, so that reduction in size of the vehicle body can be achieved.

BRIEF DESCRIPTION OF THE DRAWINGS

The advantages of the invention will become apparent in the following description taken in conjunction with the drawings, wherein.

DETAILED DESCRIPTION OF THE INVENTION

Figure 1:
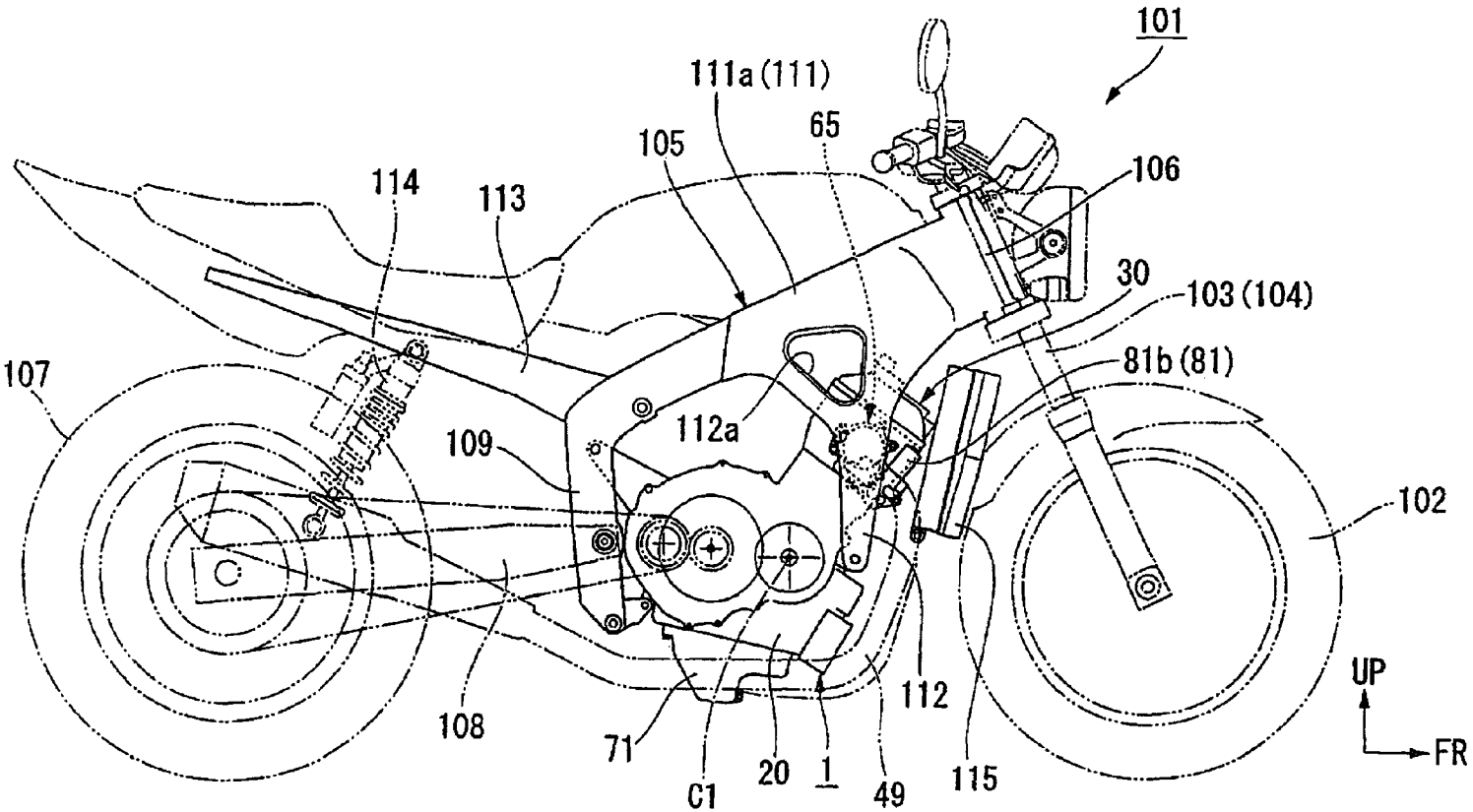
FIG. 1 is a right side elevational view showing a motorcycle.

Specific embodiments will be described below with reference to the accompanying drawings. Throughout the descriptions given hereunder, expressions indicating directions including front and rear, and right and left, mean the same directions as those in a vehicle unless otherwise specified. In the drawings, an arrow FR indicates forward of the vehicle, an arrow LH indicates leftward of the vehicle, and an arrow UP indicates upward of the vehicle.

First Embodiment

Referring to FIG. 1, a motorcycle (a saddle-riding type vehicle, a small-sized vehicle) 101 has a front wheel 102 that is journaled at a lower end portion of left and right front forks 103. A front wheel suspension system 104 that mainly includes the left and right front forks 103 is steerably pivoted by a head pipe 106 disposed at a front end of a vehicle body frame 105. On the other hand, a rear wheel 107 of the motorcycle 101 is journaled at a rear end portion of a rear swing arm 108. The rear swing arm 108 has a front end portion vertically swingably pivoted by left and right pivot plates 109 of the vehicle body frame 105 at a longitudinal intermediate portion of the vehicle body.

A pair of left and right main tubes 111 extends obliquely outwardly toward the rear from the head pipe 106. A pair of left and right down frames (engine hangers) 112 extends downwardly from lower portions at front portions of the left and right main tubes 111. A seat frame 113 extends rearwardly from rear end portions of the left and right main tubes 111. A pair of left and right rear cushion units 114 is inserted between the seat frame 113 and a rear portion of the rear swing arm 108. An engine 1 that serves as a prime mover of the motorcycle 101 has a front end portion supported by lower end portions of the left and right down frames 112.

Figure 2:
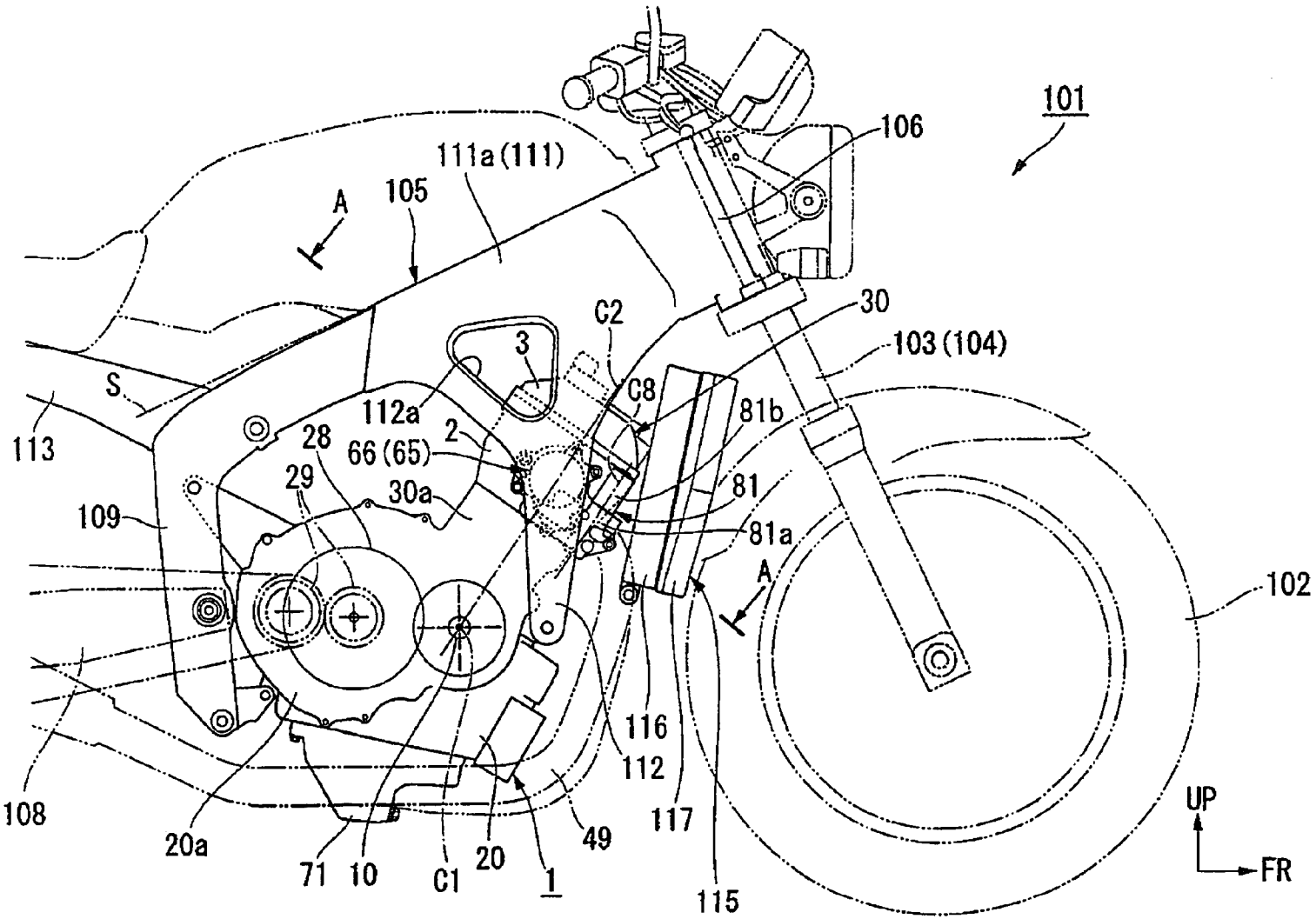
FIG. 2 is a right side elevational view showing an engine and surrounding parts of the motorcycle.

Referring also to FIG. 2, the engine 1 is a parallel four-cylinder engine having a central axis of rotation (crank axis) C1 of a crankshaft 10 extending along a vehicle width direction (crosswise direction). The engine 1 has a basic configuration of having a forwardly inclined cylinder portion 30 (having an upper portion disposed at a front side) standing upwardly of a front portion of a crankcase 20 thereof.

In accordance with the first embodiment, the left and right down frames 112 extend past sides of the cylinder portion 30 and have lower end portions connected to a front end portion of the crankcase 20 to thereby support the crankcase 20. A radiator 115 for cooling the engine 1 is disposed between the cylinder portion 30 and the front wheel 102 and the left and right front forks 103 disposed forwardly of the cylinder portion 30.

The left and right pivot plates 109 extend downwardly from rear end portions of the left and right main tubes 111. The engine 1 has a rear end portion fixedly supported by upper and lower portions of the left and right pivot plates 109. Further, the rear swing arm 108 has a front end portion supported vertically swingably at vertical intermediate portions of the left and right pivot plates 109.

It is to be noted here that the motorcycle 101 may be a so-called naked type vehicle that has no vehicle body covers or the like so as to expose many of vehicle constituent parts such as the engine 1 and the vehicle body frame 105.

Referring to FIGS. 1 through 4, the radiator 115 is a sheet-like part having a horizontally long rectangular shape in a vehicle front view. The radiator 115 includes a radiator core 116 that forms a rearwardly protruding curve in a plan view. The radiator 115 further includes a coolant incoming side tank 117 and a coolant outgoing side tank 118 disposed on either crosswise side of the radiator core 116. In addition, a radiator fan 119 is disposed on a rear surface side on the left side of the radiator core 116. The radiator 115 (radiator core 116) may be a flat sheet form, instead of the round type.

Arrangements of the engine 1 will be described below with reference to FIGS. 5, 6(*a*) and 6(*b*), and 7.

The cylinder portion 30 of the engine 1 mainly includes a cylinder main body 30*a*, a cylinder head 2, and a head cover 3. Specifically, the cylinder main body 30*a* is integrally formed on (or formed separately from, and fixedly mounted on) the crankcase 20. The cylinder head 2 is mounted on the cylinder main body 30*a*. The head cover 3 is mounted on the cylinder head 2. A valve actuating chamber 4 defined by the cylinder head 2 and the head cover 3 accommodates therein a valve actuating mechanism 5 for driving intake and exhaust valves 6, 7.

Figure 5:
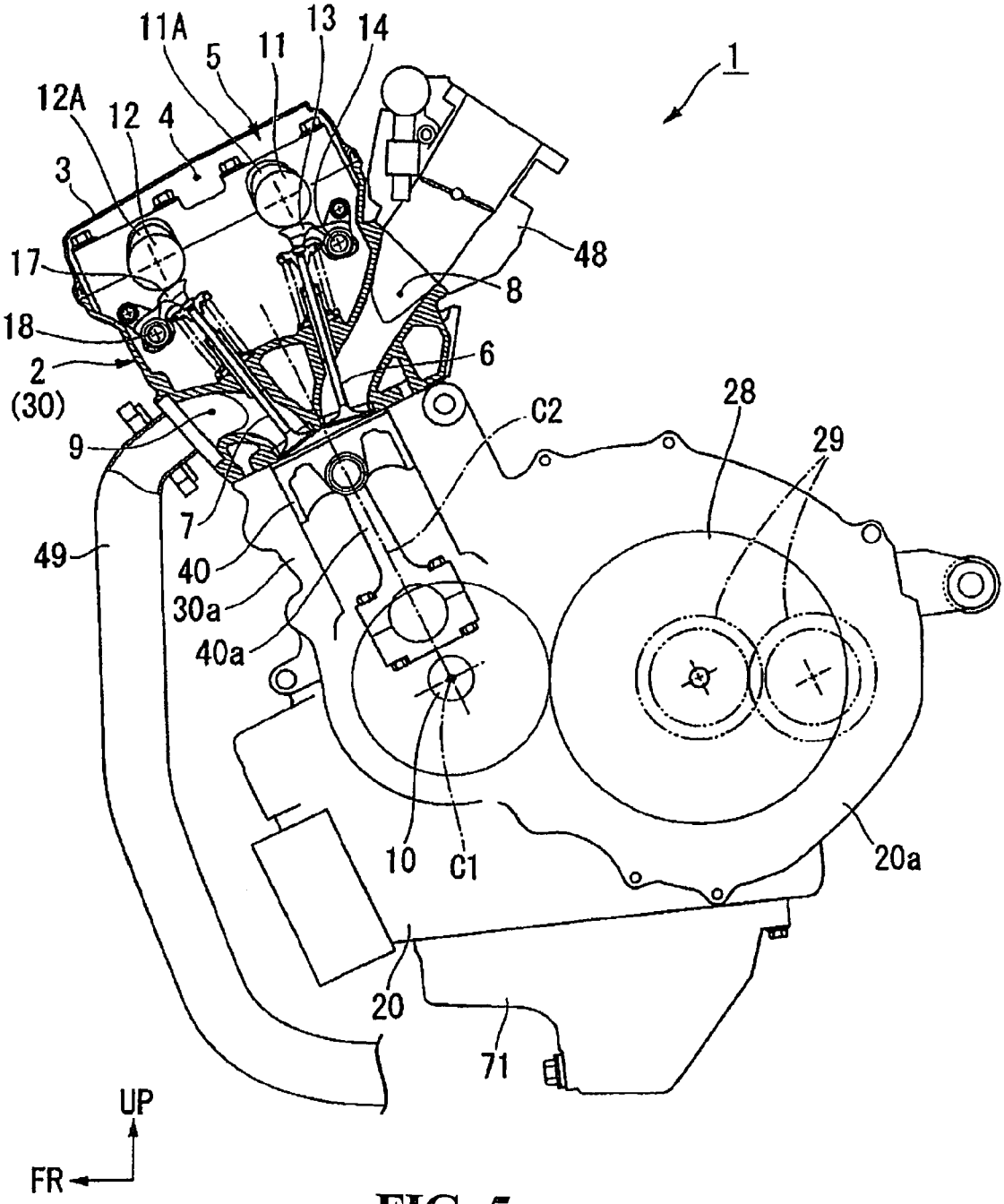
FIG. 5 is a left side elevational view showing the engine of the motorcycle.

In FIG. 5, reference symbols 8, 9 denote intake and exhaust ports formed at front and rear of the cylinder head 2 and reference symbols 11, 12 denote intake side and exhaust side camshafts, respectively. The intake and exhaust ports 8, 9 each form a pair of combustion chamber side openings for each cylinder, so that the pair of combustion chamber side openings is opened or closed by a corresponding pair of intake and exhaust valves 6, 7. Specifically, the engine 1 is a four-valve type with each cylinder having a pair of left and right intake valves 6 and a pair of left and right exhaust valves 7.

A piston 40 corresponding to each cylinder arrayed along the crank axis C1 is reciprocatingly movably fitted in the cylinder main body 30*a*. A reciprocating motion of the piston 40 is translated into a rotatable motion of the crankshaft 10 via a connecting rod 40*a*. A throttle body 48 is connected to a rear portion of the cylinder portion 30. An exhaust pipe 49 is connected to a front portion of the cylinder portion 30. Reference symbol C2 in FIG. 5 denotes a cylinder central axis (cylinder axis) that extends in a direction in which the cylinder portion 30 stands.

A transmission case 20*a* is integrally joined rearwardly of the crankcase 20. The transmission case 20*a* accommodates therein a transmission 29 and a clutch 28. The clutch 28 is disposed on a right-hand side portion of the transmission case 20*a*. A rotatable drive of the crankshaft 10 is outputted outside the engine 1 via the clutch 28 and the transmission 29.

The pair of left and right intake valves 6 for one cylinder is opened or closed by being pressed by cams 11A on the intake side camshaft 11 via an intake side rocker arm 13 provided for each cylinder. Similarly, the pair of left and right exhaust valves 7 for one cylinder is opened or closed by being pressed by cams 12A on the exhaust side camshaft 12 via an exhaust side rocker arm 17 provided for each cylinder.

The intake side rocker arm 13 is supported by an intake side rocker arm shaft 14 that is disposed rearwardly of a stem distal end portion of the intake valve 6, rockably about an axis of the intake side rocker arm shaft 14 and axially slidably. Similarly, the exhaust side rocker arm 17 is supported by an exhaust side rocker arm shaft 18 that is disposed forwardly of a stem distal end portion of the exhaust valve 7, rockably about an axis of the exhaust side rocker arm shaft 18 and axially slidably.

When the engine 1 is operated, each of the intake and exhaust side camshafts 11, 12 is rotatably driven in conjunction with the crankshaft 10, which results in each of the intake and exhaust side rocker arms 13, 17 being rocked appropriately according to an outer peripheral pattern of each of the cams 11A, 12A. Each of the intake and exhaust side rocker arms 13, 17 then presses the corresponding one of the intake and exhaust valves 6, 7, causing the intake valve 6 or the exhaust valve 7 to make a reciprocating motion to thereby open or close the combustion chamber side opening of the intake port 8 or the exhaust port 9.

The valve actuating mechanism 5 mentioned earlier is formed as a variable valve actuating mechanism capable of varying a valve open/close timing or a lift amount of each of the intake and exhaust valves 6, 7. The valve actuating mechanism 5 uses the appropriate type of cam according to an engine speed range. Specifically, when the engine 1 runs, for example, in a low speed range of an engine speed of less than 9000 rpm (revolutions per minute), the valve actuating mechanism 5 uses a cam for a low speed range in each of the intake and exhaust side camshafts 11, 12 to open and close the corresponding one of the intake and exhaust valves 6, 7; when the engine 1 runs in a high speed range of the engine speed of 9000 rpm or higher, the valve actuating mechanism 5 uses a cam for a high speed range in each of the intake and exhaust side camshafts 11, 12 to open and close the corresponding one of the intake and exhaust valves 6, 7.

In the following, the intake side for one cylinder in the valve actuating mechanism 5 will be described with reference to FIGS. 6(*a*) and 6(*b*). The same arrangements apply to the intake side of other cylinders and the exhaust side of each cylinder.

Figure 6A:
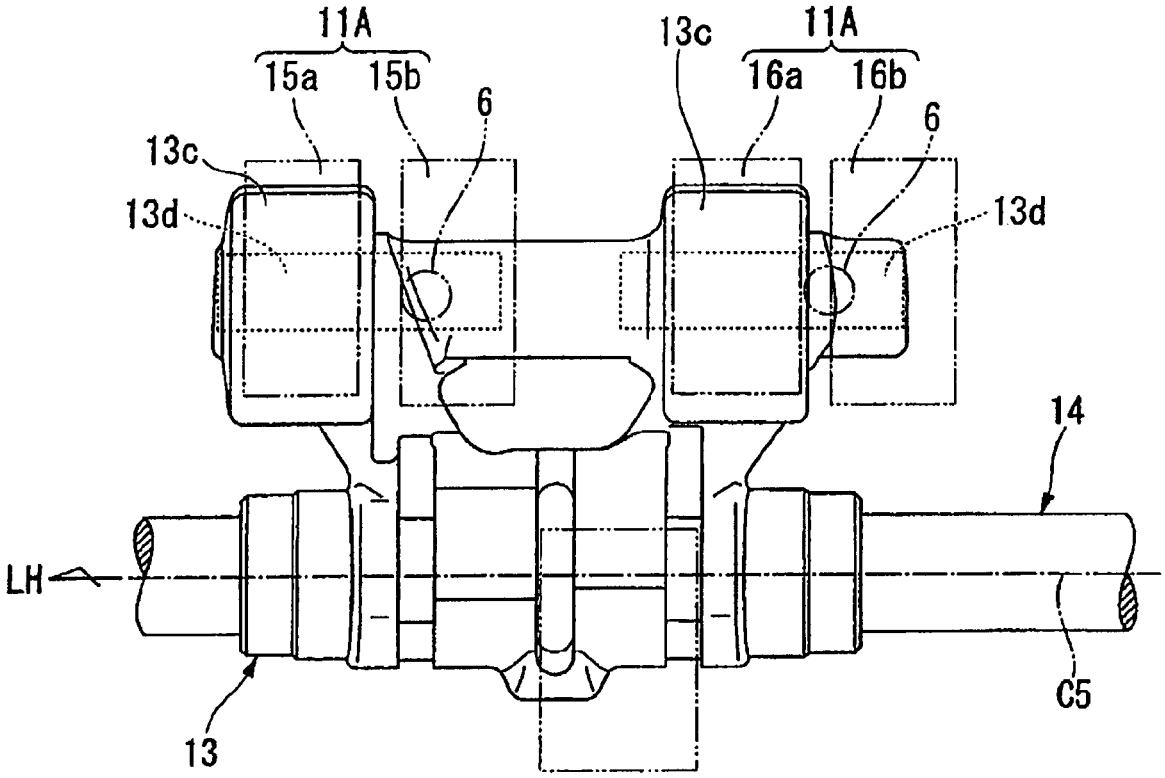
FIGS. 6(*a*) and 6(*b*) are plan views showing an essential portion of a valve actuating mechanism of the engine of the motorcycle, FIG. 6(*a*) showing a condition of the essential portion in a position operative with a low speed side cam and FIG. 6(*b*) showing a condition of the essential portion in a position operative with a high speed side cam.
Figure 6B:
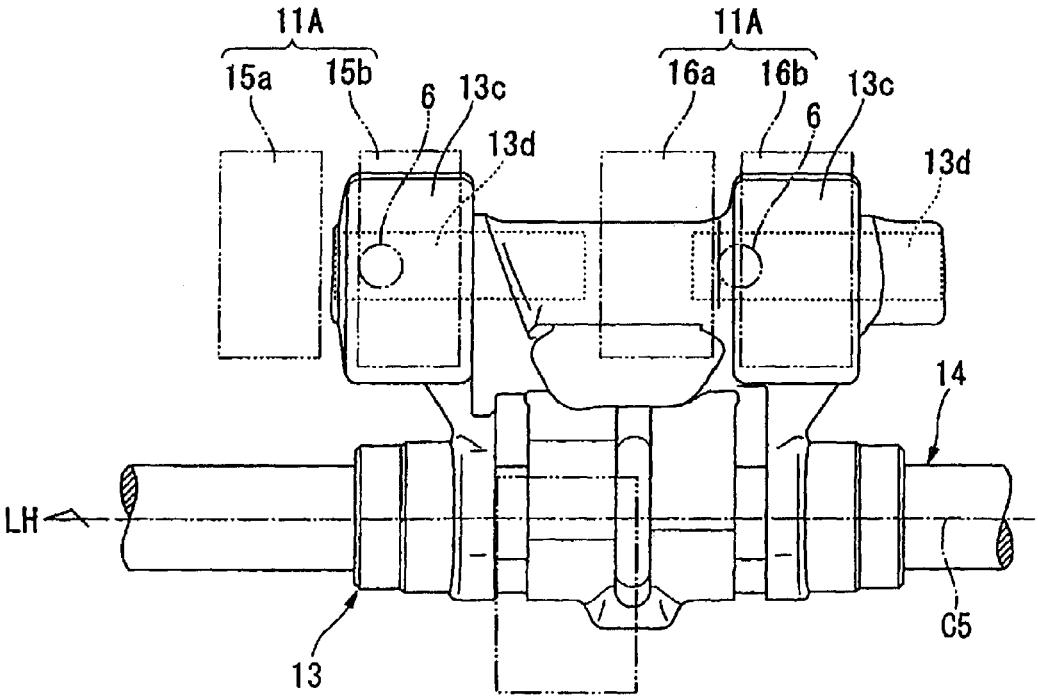

Referring to FIGS. 6(*a*) and 6(*b*), the cams 11A of the intake side camshaft 11 include left and right first cams 15*a*, 16*a* for the low speed range and left and right second cams 15*b*, 16*b* for the high speed range. Specifically, the camshaft 11 includes the left and right first cams 15*a*, 16*a* and the left and right second cams 15*b*, 16*b*, a total of four cams, for one cylinder.

When the engine 1 is stationary or runs in the low speed range, the intake side rocker arm 13 is located at a leftward stroke limit position in a direction along an axis C5 of the intake side rocker arm shaft 14 (axis C5 direction) (see FIG. 6(*a*)). In this condition, left and right cam sliding contact portions 13*c* of the intake side rocker arm 13 are disposed at positions downward of the left and right first cams 15*a*, 16*a* and to be in sliding contact with outer peripheral surfaces (cam surfaces) of the left and right first cams 15*a*, 16*a*. Left and right valve pressure portions 13*d* of the intake side rocker arm 13 are disposed such that right-hand side portions thereof can press the stem distal end portions of the left and right intake valves 6. At this time, the intake side rocker arm 13 is rocked by the left and right first cams 15*a*, 16*a* to open or close the intake valve 6.

When the engine 1 runs in the high speed range, on the other hand, the intake side rocker arm 13 is located at a rightward stroke limit position in the axis C5 direction (see FIG. 6(*b*)). In this condition, the left and right cam sliding contact portions 13*c* of the intake side rocker arm 13 are disposed at positions downward of the left and right second cams 15*b*, 16*b* and to be in sliding contact with outer peripheral surfaces (cam surfaces) of the left and right second cams 15*b*, 16*b*. The left and right valve pressure portions 13*d* of the intake side rocker arm 13 are disposed such that left-hand side portions thereof can press the stem distal end portions of the left and right intake valves 6. At this time, the intake side rocker arm 13 is rocked by the left and right second cams 15*b*, 16*b* to open or close the intake valve 6.

Referring to FIGS. 1 through 4 and 7, axial movements of the intake side rocker arm 13 (changeover of cams) are accomplished through cooperation of a rocker arm movement mechanism, a rocker arm movement restriction mechanism, and an actuator 65 that may, for example, be operated hydraulically and that is disposed at a right-hand side portion of the cylinder head 2. Specifically, with the intake side rocker arm 13 restricted from moving in the axis C5 direction by the rocker arm movement restriction mechanism, the intake side rocker arm shaft 14 is moved in the axis C5 direction to thereby store in the rocker arm movement mechanism a force required for moving the intake side rocker arm 13. Then, the movement restriction of the intake side rocker arm 13 is canceled, so that the intake side rocker arm 13 is moved in the axis C5 direction, thereby changing the cams used for operation of the intake side rocker arm 13.

Figure 7:
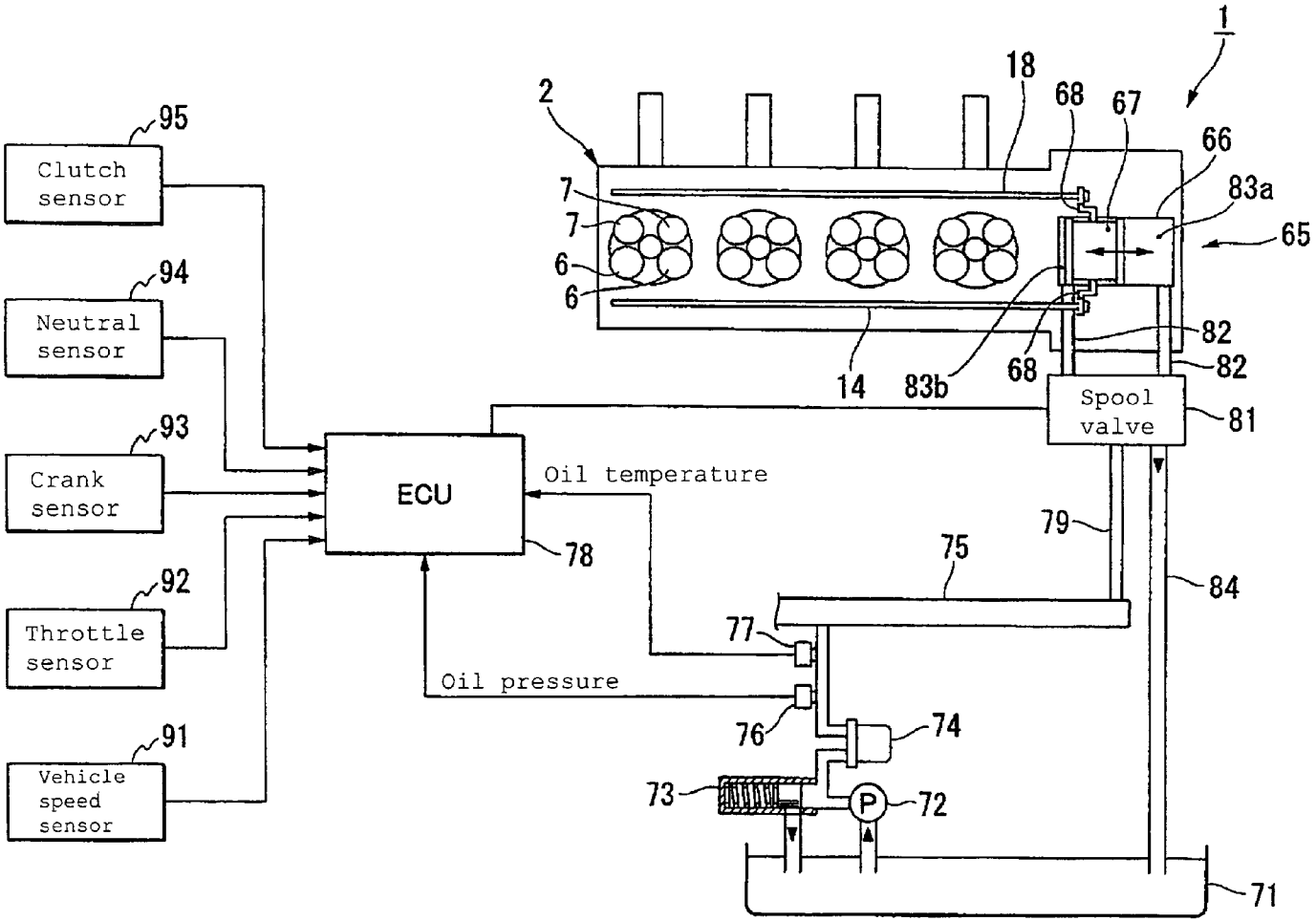
FIG. 7 is a diagram showing an arrangement of a variable valve actuating system of the valve actuating mechanism.

Referring to FIG. 7, reference symbols 72 to 77 denote an oil pump, a relief valve, an oil filter, a main oil gallery, an oil pressure sensor, and an oil temperature sensor, respectively. Further, reference symbol 79 denotes an oil path extending from the main oil gallery 75 toward a spool valve (oil control valve) 81 before the actuator 65; reference symbol 82 denotes a pair of connection oil paths that extend from the spool valve 81 toward oil chambers 83*a*, 83*b* on either side of a hydraulic cylinder 66 of the actuator 65; and reference symbol 84 denotes a return oil path from the spool valve to an oil pan 71.

Operation of the spool valve 81 is controlled by an ECU 78 that controls entire operations of the engine 1. The spool valve 81 changes hydraulic paths in order to change the cams to be used for opening or closing the intake and exhaust valves 6, 7 according to vehicle operating conditions (vehicle speed, engine speed (Ne), gear position, and the like). The ECU 78 receives inputs of various types of information, including vehicle speed information from a vehicle speed sensor 91, throttle opening information from a throttle sensor 92, crank speed (engine speed) information from a crank sensor 93, and neutral information from a neutral sensor 94 or a clutch sensor 95.

Referring also to FIGS. 9 through 12, the hydraulic actuator 65 is formed to include the hydraulic cylinder 66, a plunger 67, a cover 66*a*, and the spool valve 81. Specifically, the hydraulic cylinder 66 has a cylindrical shape with a bottom. The plunger 67 is housed in the hydraulic cylinder 66 coaxially and so as to be able to make stroke movements. The cover 66*a* of a sheet form closes an open side of the hydraulic cylinder 66. The spool valve 81 is integrally formed on a first side of the cover 66*a*.

The cover 66*a* has an outer peripheral portion that is secured to the right-hand side portion of the cylinder head 2 together with a flange formed on the open side of the hydraulic cylinder 66 through, for example, bolt fastening. The foregoing arrangement results in a good part of the hydraulic cylinder 66 being resident inside the cylinder head 2, so that the hydraulic cylinder 66 can be inhibited from protruding on the outside of the cylinder head 2 (outward side of the engine 1).

The hydraulic cylinder 66 is disposed such that an axial center thereof (axis C7) is close to the cylinder axis C2 in an engine side view. On the other hand, the spool valve 81 has an appearance of a cylinder extending vertically. The spool valve 81 is disposed such that an axial center thereof (axis C8) is orthogonal to the axis C7 of the hydraulic cylinder 66 and in parallel with the cylinder axis C2.

A casing 81*a* that forms a lower portion of the spool valve 81 is integrally formed on the first side of the cover 66*a*. The above-described plunger 67 that changes the hydraulic paths is accommodated in the casing 81*a* so as to be able to make stroke movements. The spool valve 81 has an upper portion that is formed as a solenoid 81*b* that makes the plunger 67 make a stroke movements in order to change the hydraulic paths. The solenoid 81*b* has an appearance of a cylinder that shares the abovementioned axis C8 to extend vertically.

Figure 10:
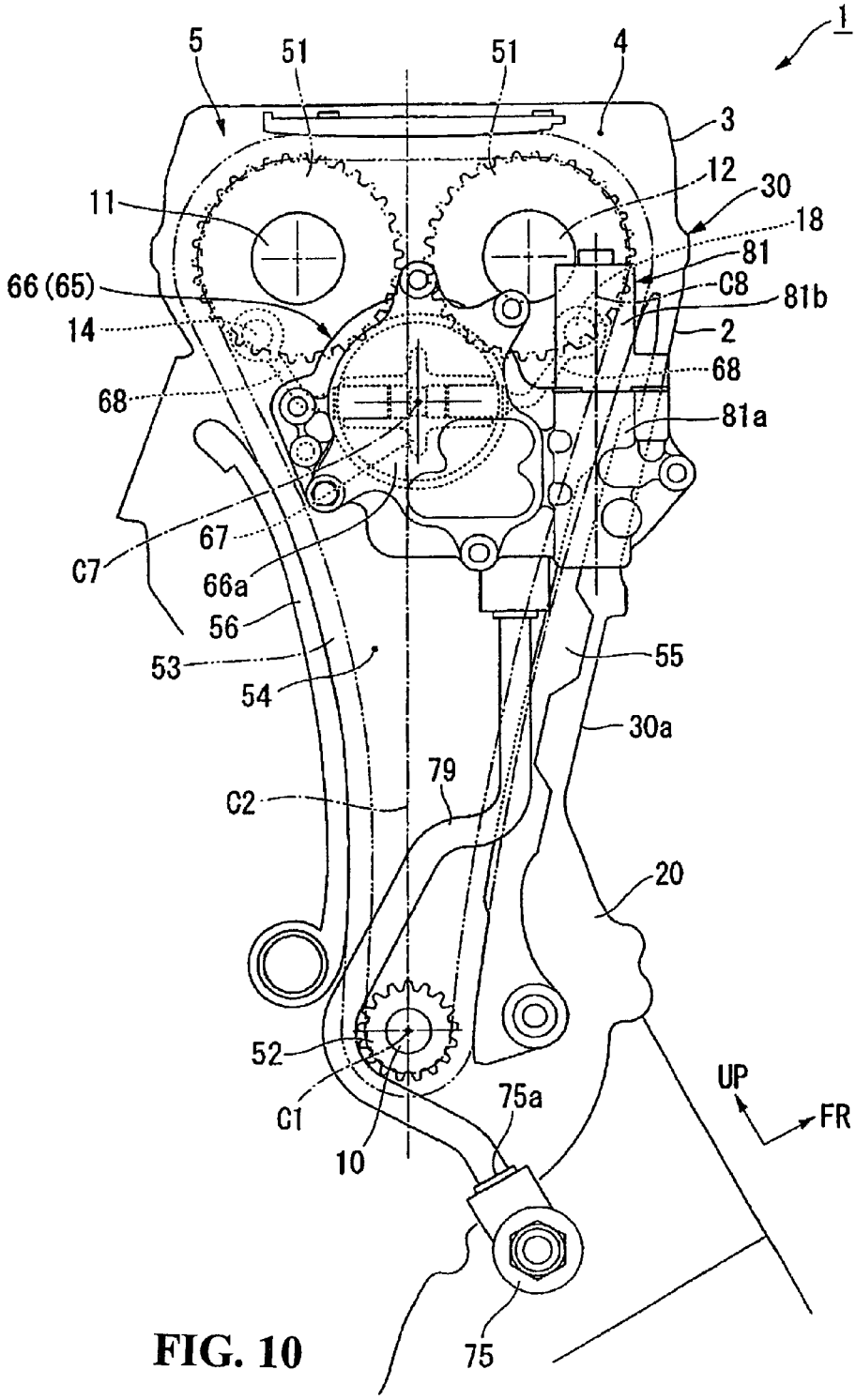
FIG. 10 is a right side elevational view showing a cylinder portion and surrounding parts of the engine of the motorcycle.
Figure 11:
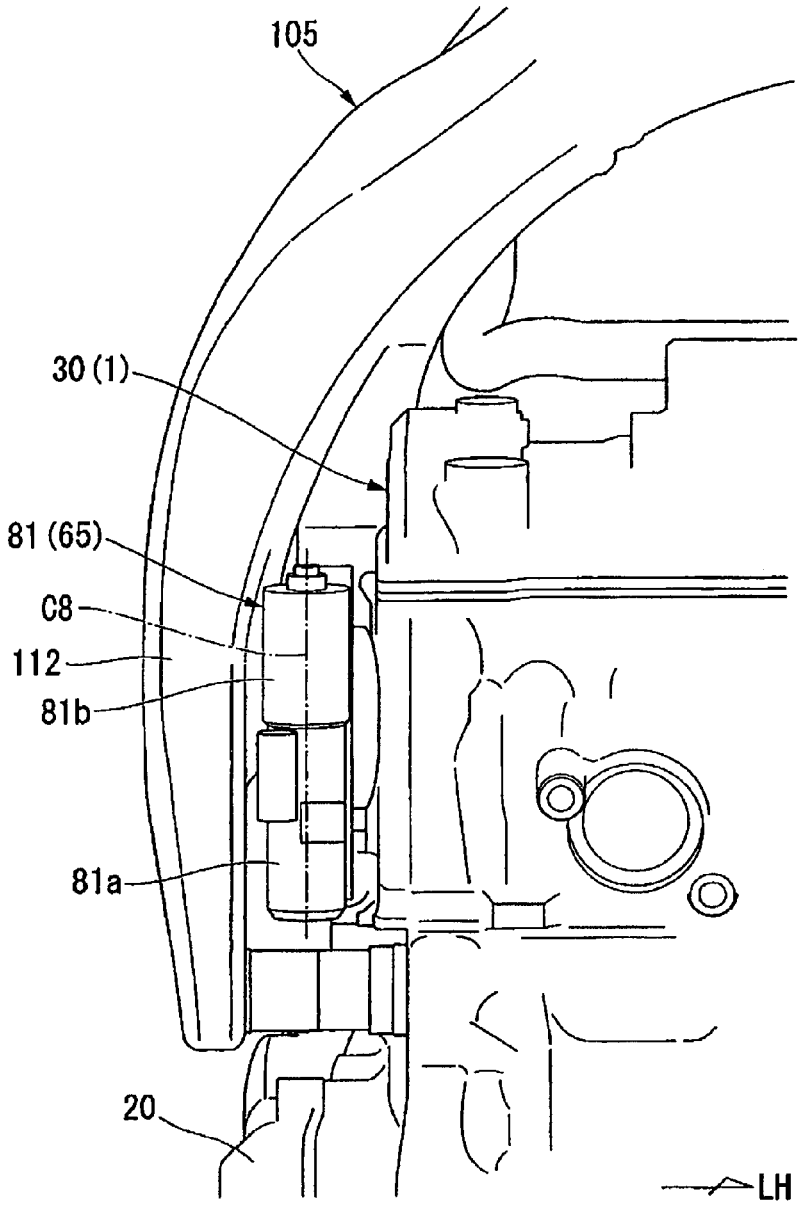
FIG. 11 is a front elevational view showing a right down frame and surrounding parts of the motorcycle.
Figure 12:
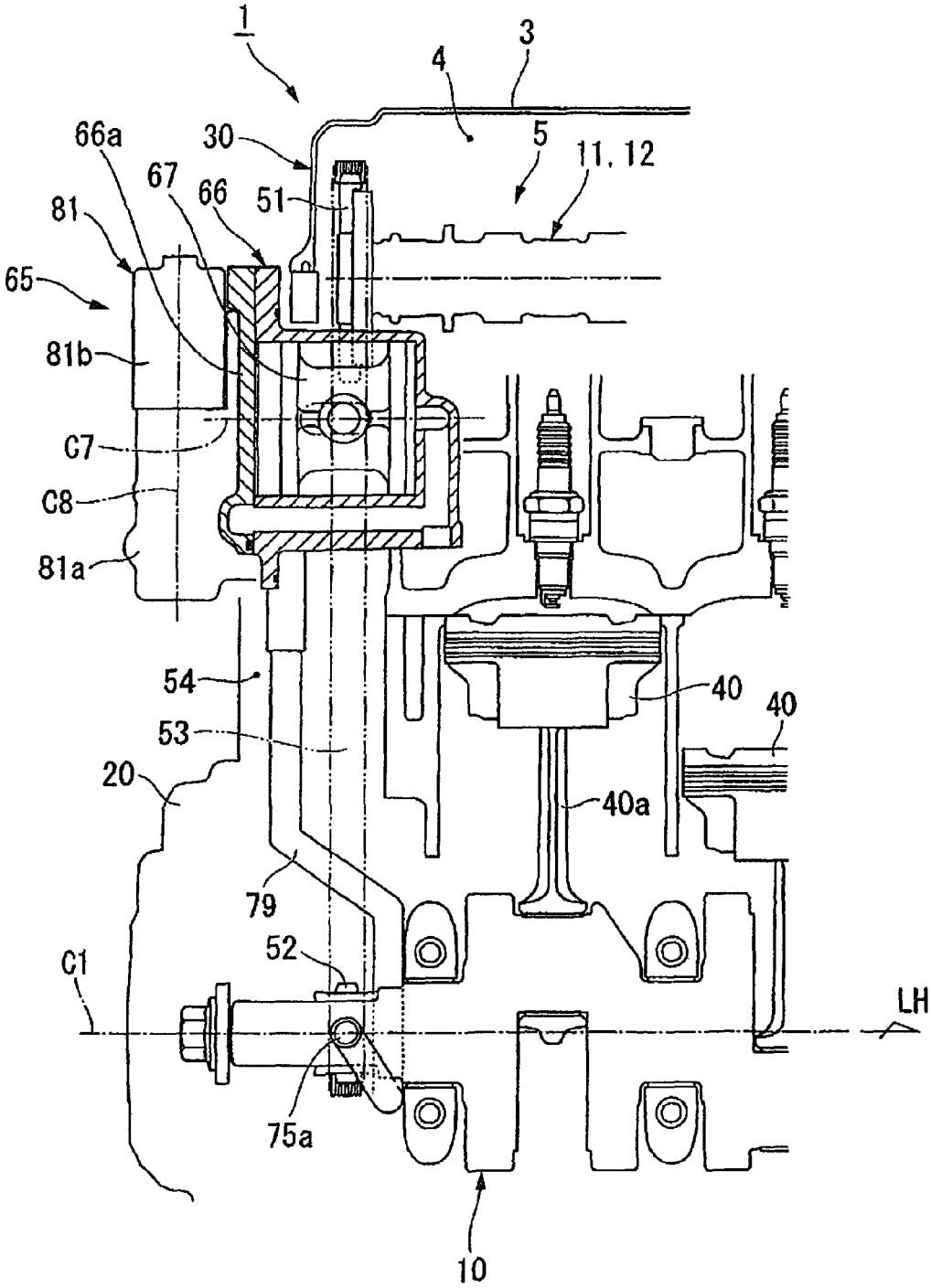
FIG. 12 is a partly cross-sectional view showing the cylinder portion and surrounding parts of the engine of the motorcycle.

Referring to FIGS. 10 and 12, reference symbol 51 denotes a cam driven sprocket disposed on a left end portion of each of the intake and exhaust side camshafts 11, 12; reference symbol 52 denotes a cam drive sprocket disposed on a left side portion of the crankshaft 10; reference symbol 53 denotes an endless cam chain trained over each of the cam driven and drive sprockets 51, 52; reference symbol 54 denotes a cam chain chamber disposed inside a right-hand side portion of the cylinder portion 30; reference symbol 55 denotes a cam chain guide that makes a sliding contact with a tight side of the cam chain 53 from a forward direction (outer peripheral side); and reference symbol 56 denotes a cam chain tensioner that makes a sliding contact with a slack side of the cam chain 53 from a rearward direction (outer peripheral side).

The hydraulic cylinder 66 is disposed such that the axial direction thereof (axial center, axis C7) extends substantially horizontally (in parallel with the crank axis C1). The hydraulic cylinder 66 is disposed to extend axially in parallel with each of the intake and exhaust side rocker arm shafts 14, 18 and so as to traverse the cam chain chamber 54 between the intake and exhaust side rocker arm shafts 14, 18. A pair of front and rear operators 68 extends from side surfaces of the plunger 67 in the hydraulic cylinder 66. Each of the front and rear operators 68 engages with a right end portion of each of the intake and exhaust side rocker arm shafts 14, 18. As a result, each of the intake and exhaust side rocker arm shafts 14, 18 can be simultaneously moved in the axis C5 direction as the plunger 67 makes a stroke movement.

The spool valve 81 is disposed, when mounted on the engine 1, such that the axial direction thereof (axial center, axis C8) is forwardly inclined (extends in parallel with the cylinder axis C2 or is orthogonal to an axial direction of the hydraulic cylinder 66. In an engine side view (vehicle side view, axial view of the hydraulic cylinder 66), the spool valve 81 is disposed forwardly of, and so as to bypass, the hydraulic cylinder 66. This inhibits the spool valve 81 from protruding on the outside of the cylinder head 2 (outward side of the engine 1).

Hydraulic pressure from the oil pump 72 is supplied to the main oil gallery 75 via the relief valve 73 and the oil filter 74. The main oil gallery 75 extends substantially immediately below the crankshaft 10 in a direction in which the cylinders are arranged (vehicle width direction) (specifically, in parallel with the crankshaft 10). The main oil gallery 75 can supply, for example, crank bearings of each cylinder, with an engine oil as adequately.

An oil supply hole 75*a* is disposed at a right end portion of the main oil gallery 75. The oil path 79 extends from the oil supply hole 75*a* toward the spool valve 81 of the hydraulic actuator 65. The spool valve 81 is capable of selectively supplying the oil chambers 83*a*, 83*b* on both sides of the hydraulic cylinder 66 with the hydraulic pressure from the oil path 79 through the two connection oil paths 82. By supplying either one of the oil chambers 83*a*, 83*b* with the hydraulic pressure from the oil pump 72 via the spool valve 81, the plunger 67 makes a stroke movement to move each of the intake and exhaust side rocker arm shafts 14, 18 in the axis C5 direction.

Through the axial movement of each of the intake and exhaust side rocker arm shafts 14, 18, the corresponding one of the intake and exhaust side rocker arm shafts 14, 18 moves from one stroke limit position to the other, or vice versa. A force to slide the intake side rocker arm 13 from the one stroke limit position to the other is thereby generated in either a first rocker arm movement mechanism 21 or a second rocker arm movement mechanism 22.

Arrangements of the vehicle body frame 105 will be described below with reference FIGS. 1 through 4 and 8.

Figure 8:
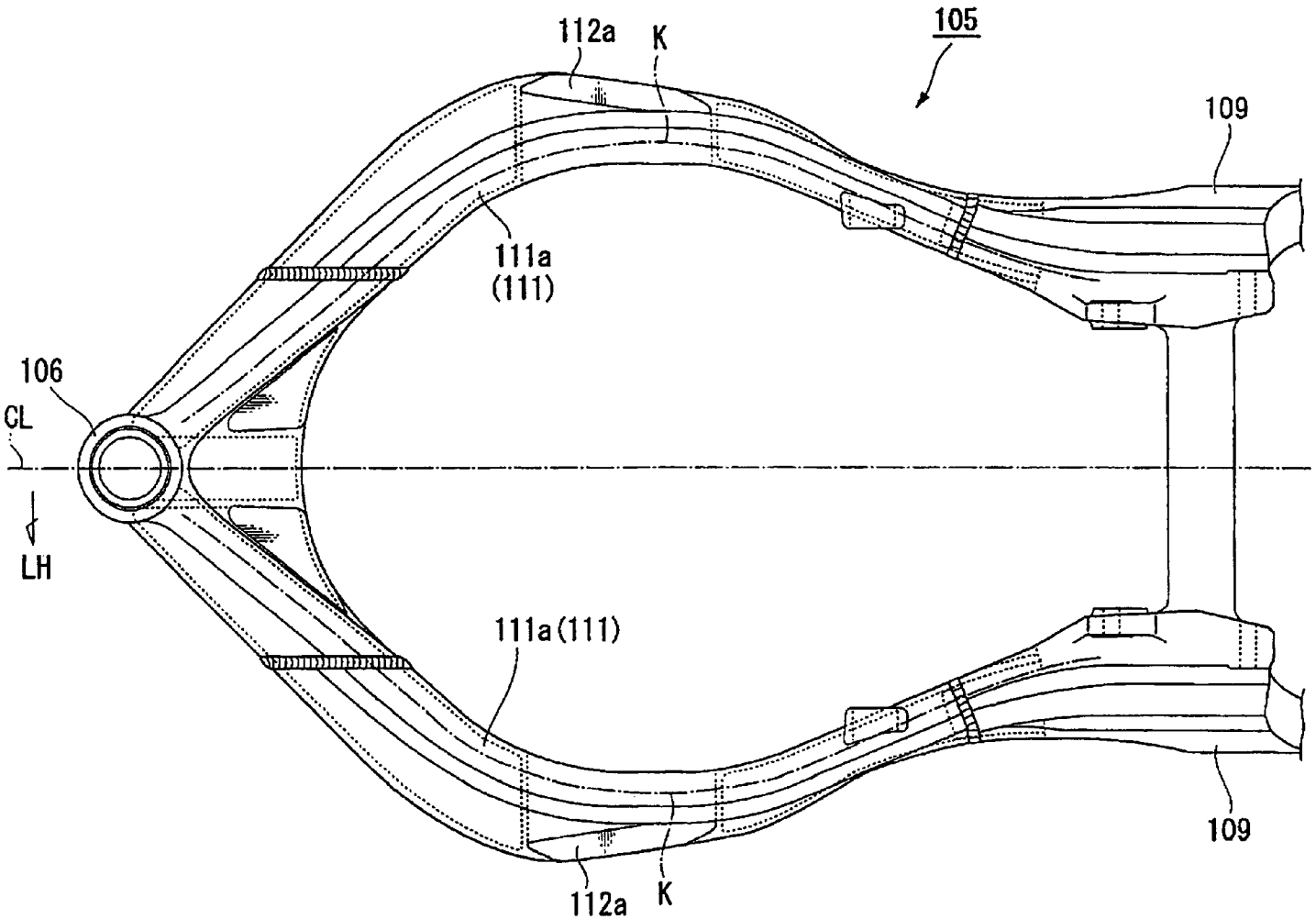
FIG. 8 is a plan view showing a vehicle body frame of the motorcycle.
Figure 9:
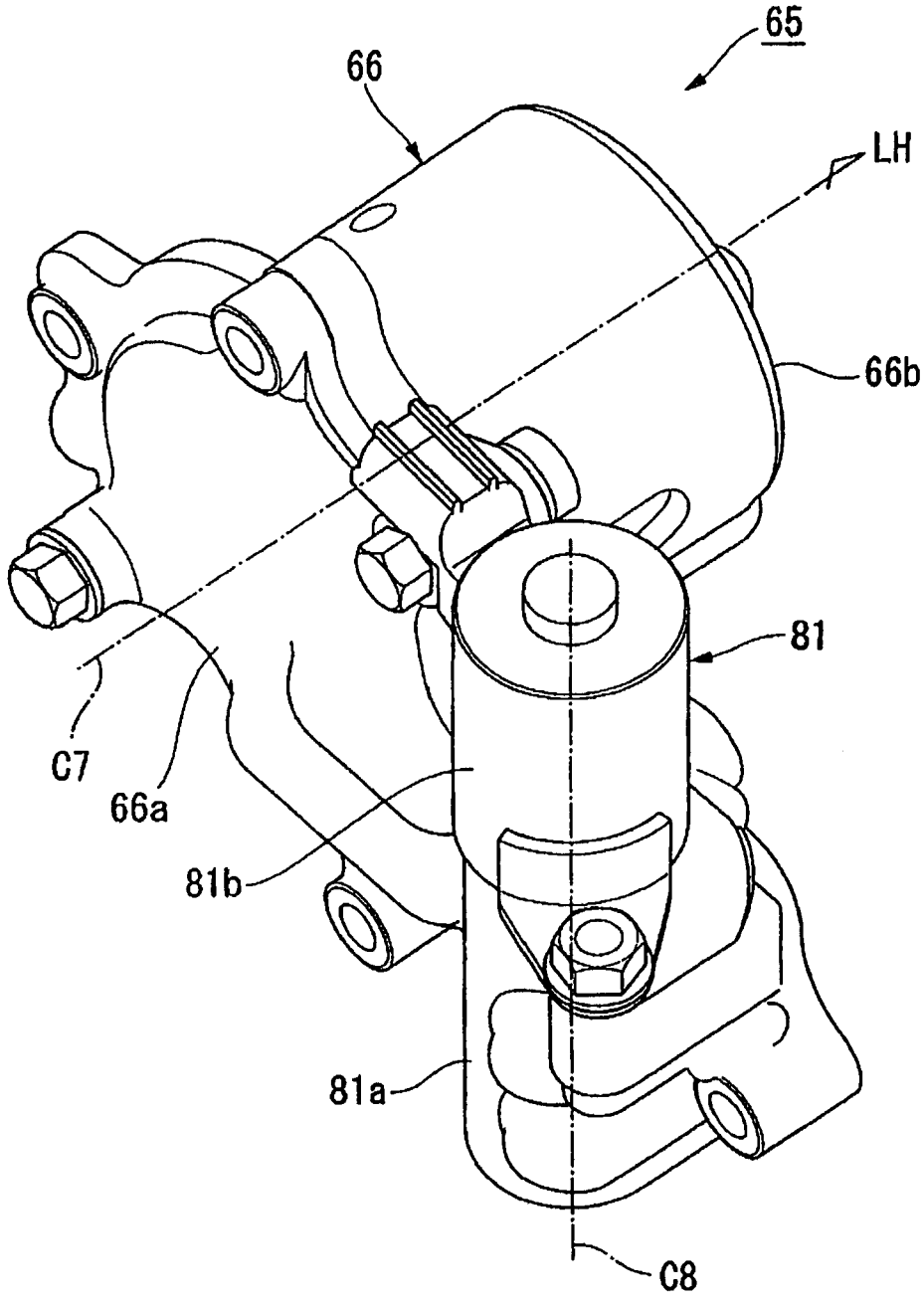
FIG. 9 is a perspective view showing a hydraulic actuator that operates the valve actuating mechanism.

The head pipe 106 has a cylindrical shape that is inclined such that an upper portion thereof is disposed rearwardly. The left and right main tubes 111 extend obliquely downwardly toward the rear so as to follow along a rearwardly downward inclined plane S that is substantially orthogonal to an axis of the head pipe 106. The left and right main tubes 111 extend, in a top view (arrow view shown in FIG. 8) that is orthogonal to the inclined plane S, so as to branch off from each other obliquely rearwardly toward the outside from both sides of a rear portion of the head pipe 106. The left and right main tubes 111 then mildly curve obliquely rearwardly toward the inside at a longitudinally intermediate portion. The left and right main tubes 111 are then connected to front sides at upper end portions of the left and right pivot plates 109 that are disposed substantially in parallel with each other. In FIG. 8, reference symbol CL denotes a vehicle body centerline and reference symbol K denotes a curve that curves along a direction in which the left and right main tubes 111 extend.

The left and right main tubes 111 have a cross section of a vertically long, hollow rectangular shape to extend along the curve K. The cross section has a vertical width that is substantially orthogonal to the inclined plane S and greater than a crosswise width that is substantially in parallel with the inclined plane S. A portion of the left and right main tubes 111 extending linearly in a side view from the head pipe 106 to the pivot plates 109 (hereinafter referred to as a frame main body 111*a*) may be divided into a front half portion and a rear half portion. The front half portion has a vertical width that is substantially the same as an axial length of the head pipe 106, whereas the rear half portion has a vertical width that is made relatively small.

The down frame 112 that tapers in a side view extends downwardly from a lower side of the front half portion of the frame main body 111*a*. The down frames 112 have a band shape that substantially covers a vehicle body outer side surface. The engine 1 has a front end portion (a front end portion of the crankcase 20 in, for example, FIG. 1) connected to, and thereby supported by, a leading end portion (lower end portion) of each of the left and right down frames 112. A portion that extends from a lower side of the front half portion to an upper portion of the down frame 112 includes an opening 112*a* that penetrates in the vehicle width direction and has a triangular shape in a side view.

The down frames 112 have lower portions that are disposed so as to follow along left and right side surfaces of the cylinder portion 30 (so as to be substantially orthogonal to the crosswise direction). The hydraulic actuator 65 is disposed so as to be on the inside in the crosswise direction of the right down frame 112 of the two down frames 112 (inside in the vehicle width direction). The right down frame 112 is displaced on the outside in the crosswise direction (outside in the vehicle width direction) relative to the left down frame 112. A portion of the hydraulic actuator 65 that protrudes toward the outside of the cylinder portion 30 is disposed between the right down frame 112 and the right side surface of the cylinder portion 30.

Referring now to FIGS. 1 through 4, the spool valve 81 is disposed at a portion sideways of the cylinder head 2 and on the side closer to the radiator 115 (front side) in a condition such that the axis C8 of the spool valve 81 extends in parallel with the cylinder axis C2. Additionally, the spool valve 81 is disposed at a position that is rearward of the radiator 115 in the vehicle side view (engine side view) and that falls within a vertical span of the radiator 115.

Figure 3:
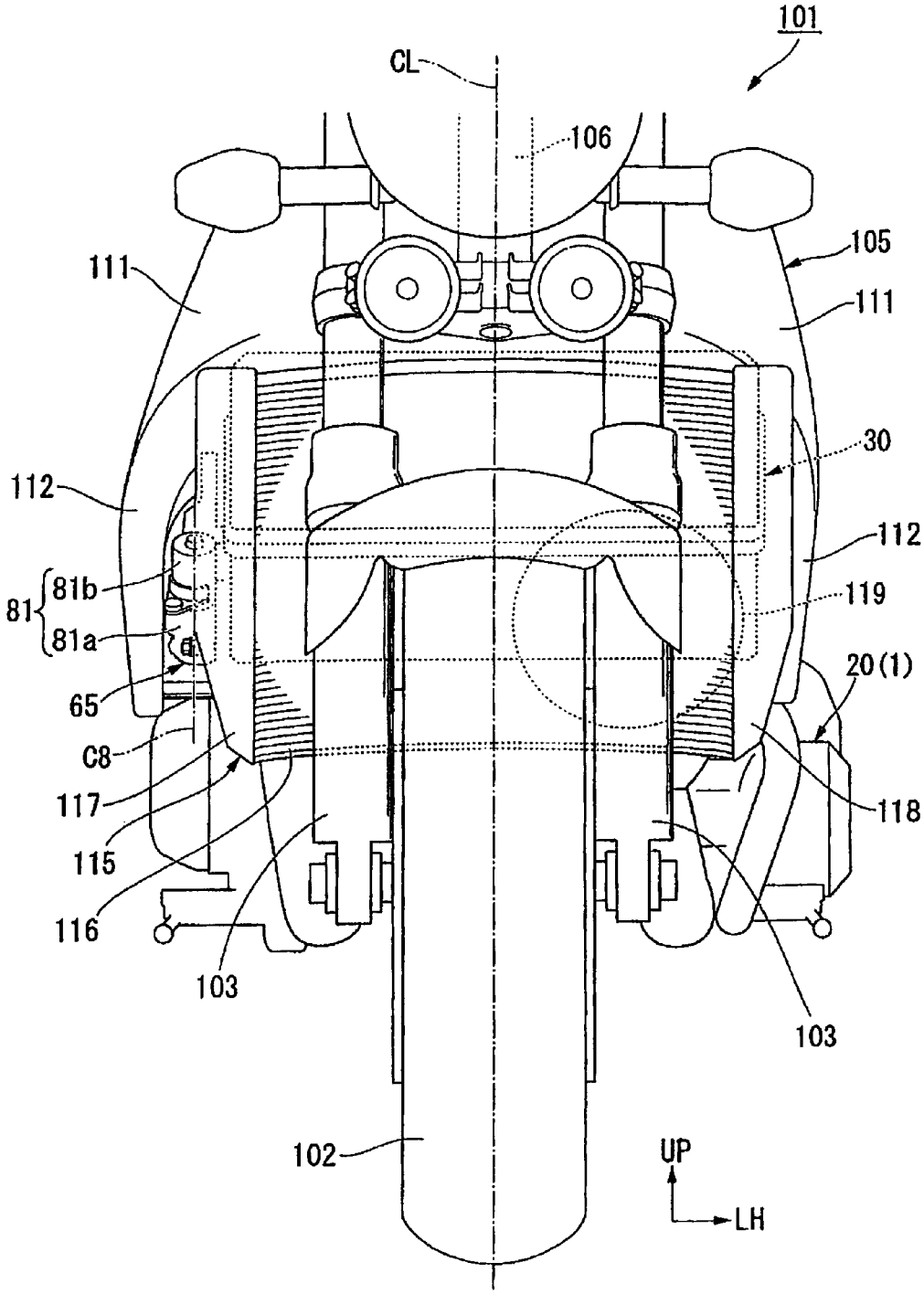
FIG. 3 is a front elevational view showing the engine and surrounding parts of the motorcycle.
Figure 4:
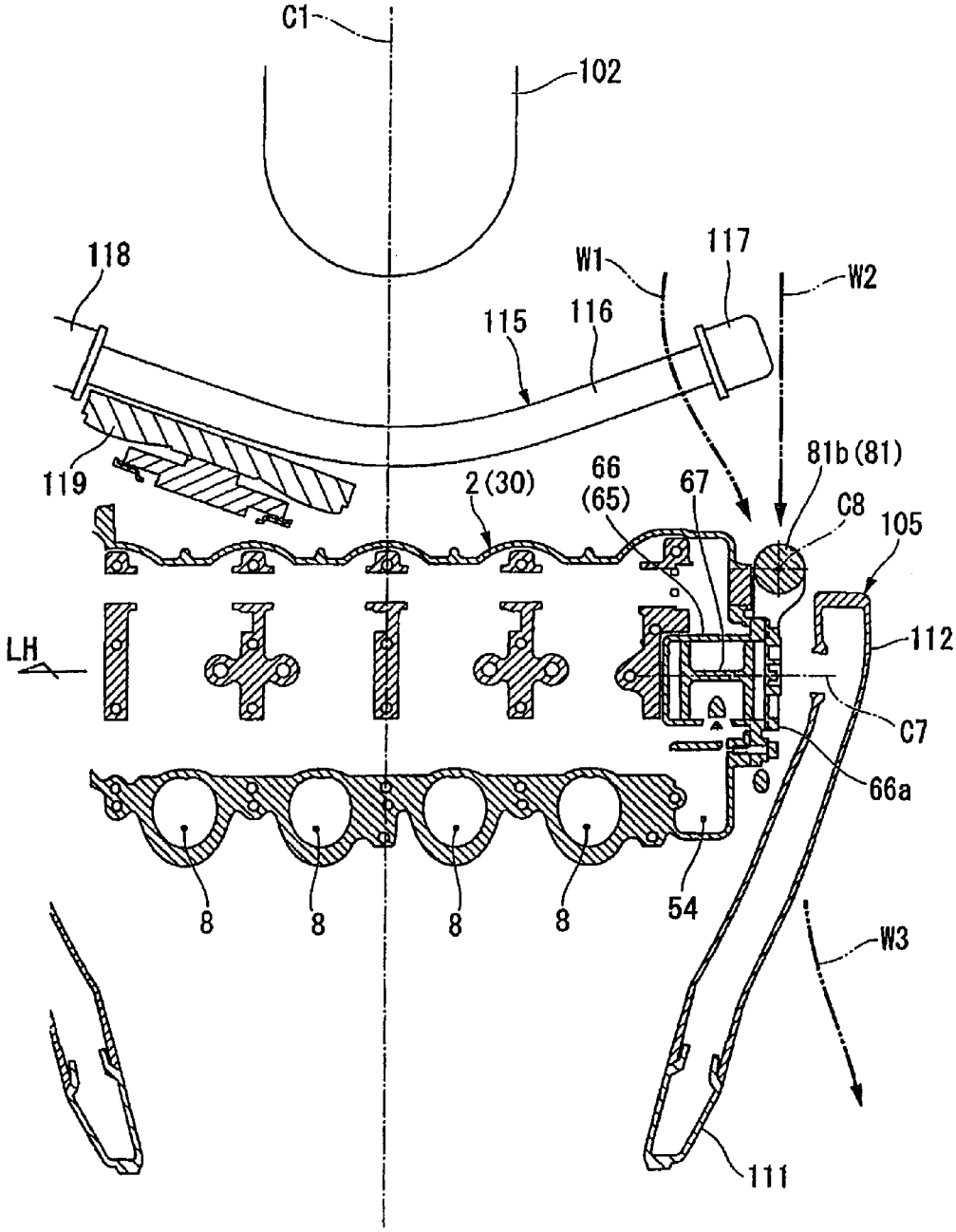
FIG. 4 is a cross-sectional view taken along line 4-4 of FIG. 2.

In addition, the spool valve 81 is disposed such that the axis C8 thereof substantially overlaps an outside edge of the radiator 115 in the vehicle front view (see FIG. 3). Further, an outside portion of the spool valve 81 that forms a cylindrical appearance (portion outside the axis C8) is configured to protrude on the outside relative to the outside edge of the radiator 115 in the vehicle front view. The hydraulic actuator 65 is disposed such that a portion thereof excluding the spool valve 81 generally overlaps the left and right down frames 112 thereinside in the vehicle side view.

Further, at least the solenoid 81*b* of the spool valve 81 is disposed at a portion forward of the down frame 112 and rearward of the radiator 115 in the vehicle side view. Specifically, the portion of the spool valve 81 that tends to be bulky on the vehicle outside is disposed in a space between the down frame 112 and the radiator 115 in the vehicle side view.

As described heretofore, the motorcycle 101 according to the first embodiment is mounted with the engine 1 having the cylinder portion 30 that stands upright in a condition of being mounted on the vehicle and has the radiator 115 disposed adjacent to the engine 1 on the forward side of the vehicle and the spool valve 81 for controlling the hydraulic pressure for the valve actuating mechanism 5 of the engine 1. In motorcycle 101, the spool valve 81 is disposed sideways of the cylinder portion 30 (cylinder head 2) such that the axis C8 of the spool valve 81 extends substantially in parallel with the axis C2 of the cylinder portion 30. Further, the spool valve 81 is disposed at a position that is rearward of the radiator 115 and that falls within the vertical width of the radiator 115 in the vehicle side view.

In accordance with the foregoing arrangements, the spool valve 81 is disposed sideways of the cylinder portion 30 (cylinder head 2) that stands upright on the engine 1. This makes an air flow from a vehicle forward direction tend more easily to blow against the spool valve 81 without being blocked by the cylinder portion 30. Additionally, the arrangement in which the spool valve 81 is disposed at the position that is rearward of the radiator 115 and that falls within the vertical span of the radiator 115 in the vehicle side view allows the spool valve 81 to be disposed at a position through which the air flow is generally easy to flow. By actively exposing the spool valve 81 to the air flow in the manner as described above, cooling efficiency of the spool valve 81 is enhanced, so that effect of heat from the cylinder portion 30 and from that generated by the valve can be inhibited. Further, the axis C8 of the spool valve 81 is arranged to extend along the axis C2 of the cylinder portion 30, which inhibits the spool valve 81 from bulging outwardly of the cylinder portion 30. This enhances the degree of freedom in disposing the spool valve 81.

In the motorcycle 101 according to the first embodiment, the spool valve 81 is disposed sideways of the cylinder portion 30 (cylinder head 2) and on the side closer to the radiator 115. As a result, the spool valve 81 is disposed close to the radiator 115, so that the air flow can be even more actively blown against the spool valve 81. This further enhances the cooling efficiency of the spool valve 81.

In the motorcycle 101 according to the first embodiment, the spool valve 81 is disposed such that at least part of the spool valve 81 bulges outwardly of a crosswise width of the radiator 115 in a vehicle front view. This allows an air flowing along left and right sides of the radiator 115 to be blown against the spool valve 81, so that the cooling efficiency of the spool valve 81 can be further enhanced.

In addition, the motorcycle 101 according to the first embodiment further includes the down frames 112 that extend vertically sideways of the cylinder portion 30 to thereby support the engine 1. At least part of the spool valve 81 (solenoid 81*b*) is disposed between the down frame 112 and the radiator 115 in the vehicle side view. The portion of the spool valve 81, such as the solenoid 81*b*, that tends to be bulky on the vehicle outside can be disposed to circumvent the down frame 112 and the radiator 115 by using the space between the down frame 112 and the radiator 115 in the vehicle side view. The vehicle width around the spool valve 81 can therefore be kept small, so that reduction in size of the vehicle body can be achieved.

Second Embodiment

Figure 13:
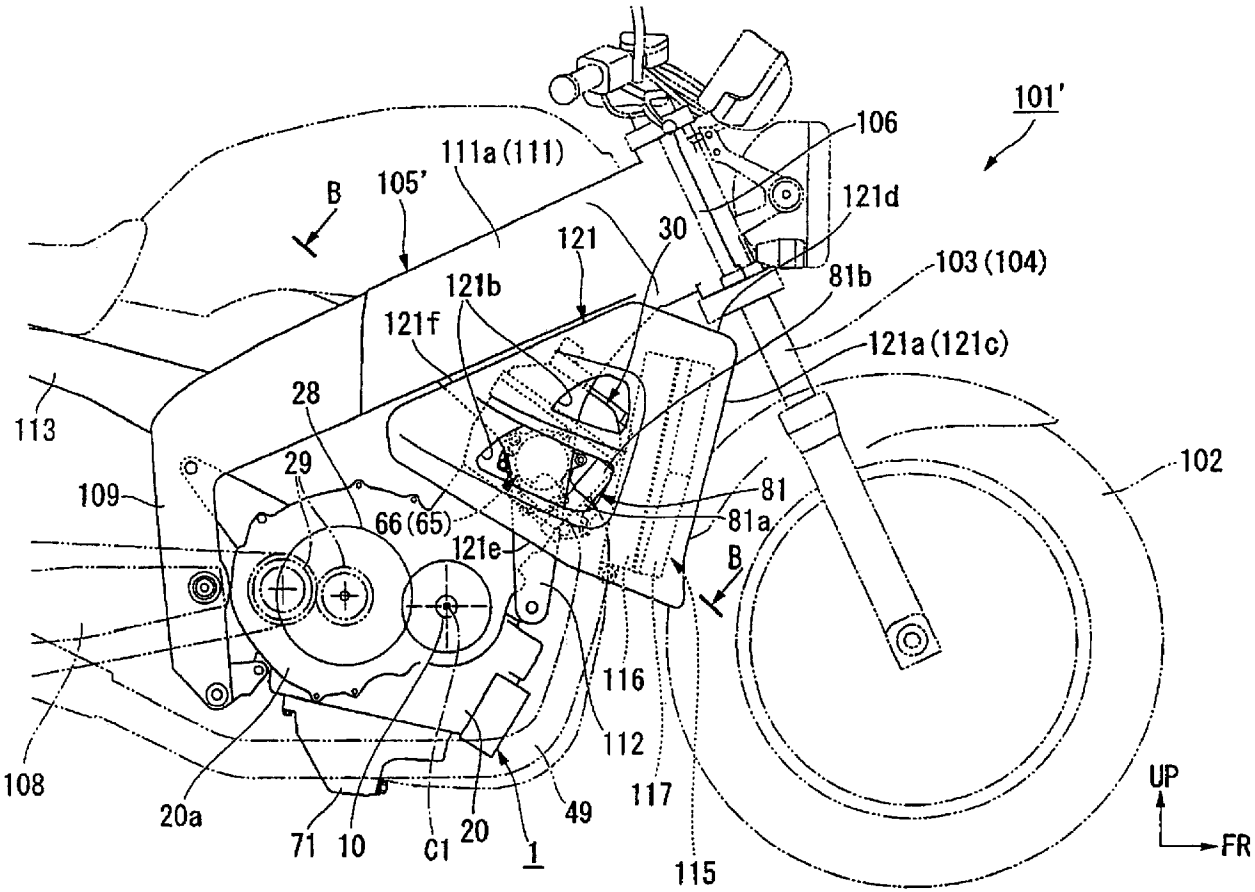
FIG. 13 is a right side elevational view showing an engine and surrounding parts of a motorcycle according to a second embodiment.
Figure 14:
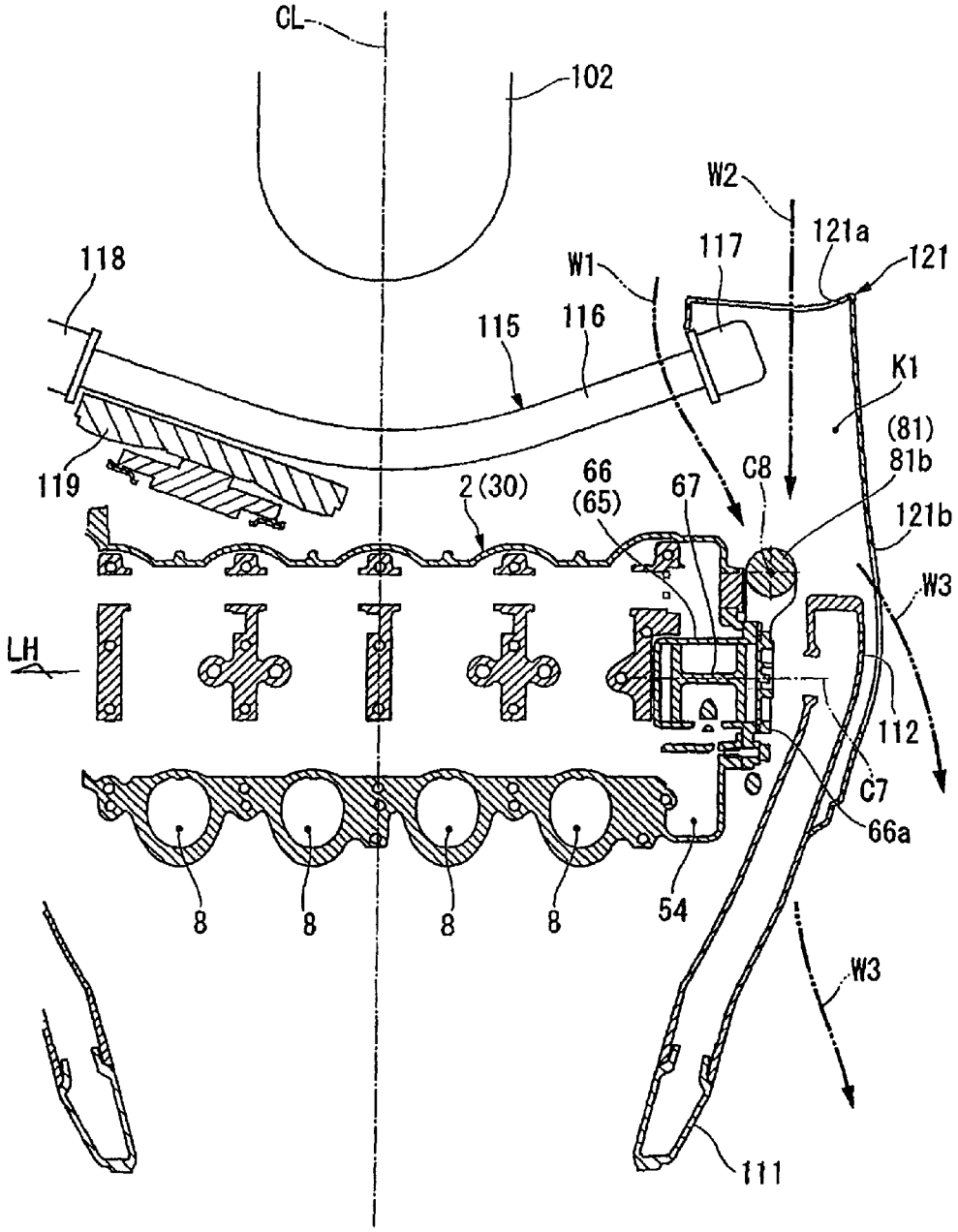
FIG. 14 is a cross-sectional view taken along line 14-14 of FIG. 13.

A second embodiment of the present invention will be described below with reference to FIGS. 13 and 14.

A motorcycle 101' according to the second embodiment differs mainly from the motorcycle 101 according to the first embodiment in the following points. Specifically, the motorcycle 101' includes a radiator cover 121 that covers a portion extending from a side of the radiator 115 to a side of the engine 1 (cylinder head 2). The spool valve 81 is disposed inside the radiator cover 121 in the vehicle width direction. Like or corresponding parts are identified by the same reference symbols as those used for the first embodiment and descriptions for those parts will be omitted.

The radiator cover 121 has a slightly forwardly inclined trapezoidal shape in a vehicle side view. The radiator cover 121 includes a front edge portion 121*c*, upper and lower edge portions 121*d*, 121*e*, and a rear edge portion 121*f*. Specifically, front edge portion 121*c* is forwardly inclined so as to follow along the radiator 115. The upper and lower edge portions 121*d*, 121*e* are inclined upwardly toward the rear from upper and lower edges of the front edge portion 121*c*. The rear edge portion 121*f* is inclined upwardly toward the front so as to follow along a lower edge of the main tube 111.

The front edge portion 121*c* of the radiator cover 121 includes an air inlet port 121*a* that opens forwardly of the vehicle. An air flow (see an arrow W2 in FIG. 14) introduced through the air inlet port 121*a* into the inside in the vehicle width direction of the radiator cover 121 (inside the radiator cover 121) flows past an outside of the radiator 115 through an air flow path K1 formed inside the radiator cover 121. In addition, an air flow that flows through the radiator core 116 (see an arrow W1 in FIG. 14) also flows through the air flow path K1. The air flow in the air flow path K1 is discharged to the outside in the vehicle width direction of the radiator cover 121 (outside the radiator cover 121) and rearwardly of the vehicle (see an arrow W3 in FIG. 3) from air outlet ports 121*b* formed in upper and lower steps in a side surface of the radiator cover 121.

The air flow inside the radiator cover 121 is effectively drawn from the air outlet ports 121*b* by negative pressure generated through running, which results in an increased air flow through the radiator 115 for the improved engine cooling performance. Further, the spool valve 81 that is disposed inside the radiator cover 121 in the vehicle width direction allows the spool valve 81 to be exposed effectively to the air flow. Effect of disturbance of various sorts on the spool valve 81 can also be inhibited. Note further that the motorcycle 101' differs from the motorcycle 101 in that the motorcycle 101' includes a vehicle body frame 105' having no opening 112*a* mentioned earlier.

As described heretofore, the motorcycle 101' according to the second embodiment includes the radiator cover 121 that covers the portion extending from the side of the radiator 115 to the side of the engine 1. Further, the air flow path K1 is formed, and the spool valve 81 is disposed, inside the radiator cover 121. The spool valve 81 can therefore be exposed to the air that flows inside the radiator cover 121, so that the cooling efficiency of the spool valve 81 can be further enhanced.

Third Embodiment

Figure 15:
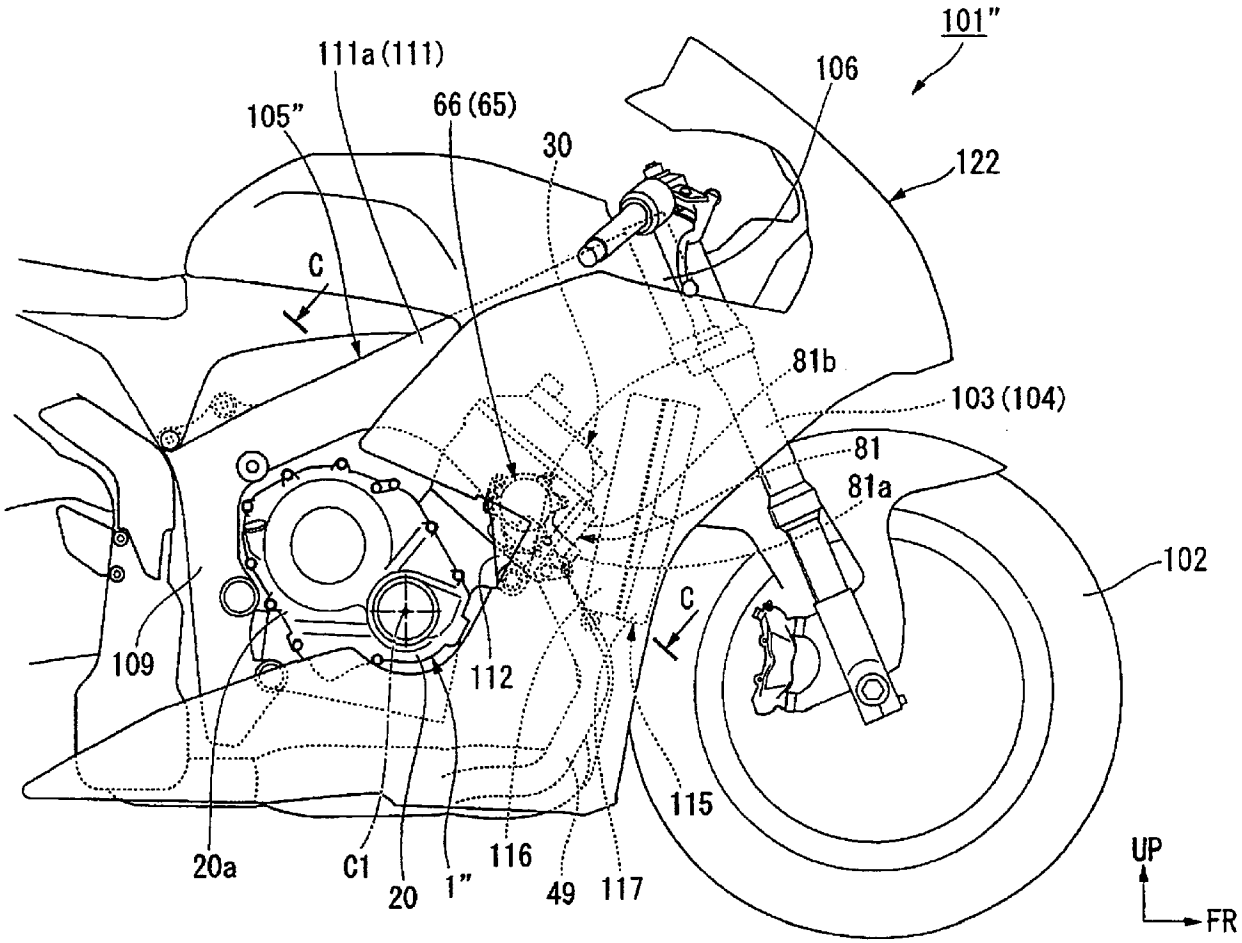
FIG. 15 is a right side elevational view showing an engine and surrounding parts of a motorcycle according to a third embodiment.
Figure 16:
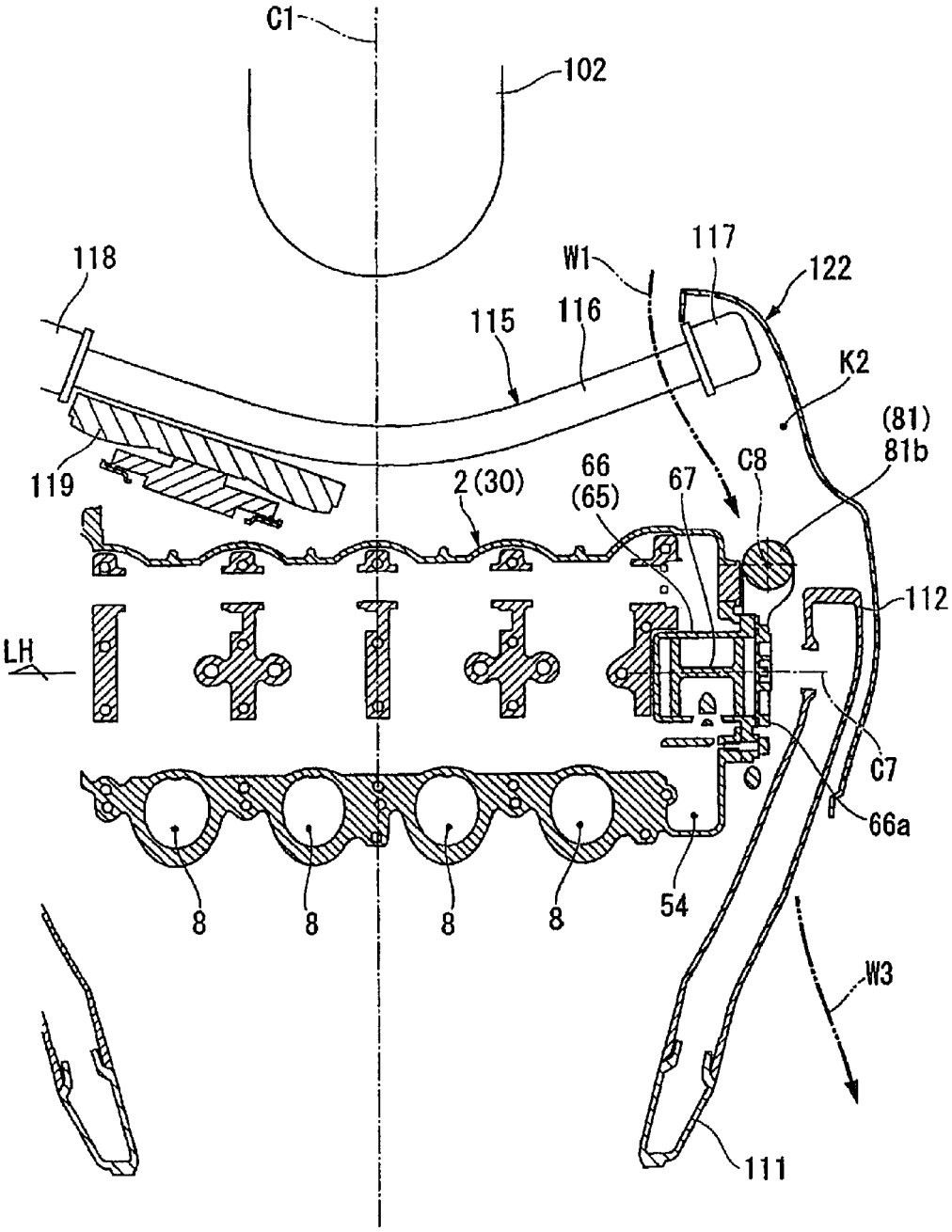
FIG. 16 is a cross-sectional view taken along line 16-16 of FIG. 15.

A third embodiment will be described below with reference to FIGS. 15 and 16.

A motorcycle 101" according to the third embodiment differs mainly from the motorcycle 101 according to the first embodiment in the following points. Specifically, the motorcycle 101" includes a cowling 122 that covers a front portion of the vehicle body. The spool valve 81 is disposed inside the cowling 122 in the vehicle width direction. Like or corresponding parts are identified by the same reference symbols as those used for the first embodiment and descriptions for those parts will be omitted.

The cowling 122 covers a portion that extends, in a side portion in a vertical intermediate portion thereof (hereinafter referred to as a cowl side portion 122*a*), from a side of the radiator 115 to a side of an engine 1" (cylinder head 2). The spool valve 81 is disposed inside the cowl side portion 122*a* in the vehicle width direction.

The cowl side portion 122*a* includes a front edge portion that covers a side edge portion (the incoming side tank 117 and the outgoing side tank 118) of the radiator 115 from the forward direction. An air flow path K2 through which an air flow (see an arrow W1 in FIG. 16) that has passed through the radiator 115 flows is formed inside the cowl side portion 122*a* in the vehicle width direction. The air flow that has flowed through the air flow path K2 is discharged outwardly of the cowl and rearwardly of the vehicle through a rear end edge of the cowl side portion 122*a* (see an arrow W3 in FIG. 16).

The motorcycle 101" differs from the motorcycle 101 also in the following points. Specifically, whereas the motorcycle 101 is mounted with the engine 1 having the crankshaft and a pair of transmission shafts disposed planarly and has the vehicle body frame 105 having the down frames 112 connected to the front end portions of the crankcase 20, the motorcycle 101" is mounted with the engine 1" having a crankshaft and a pair of transmission shafts disposed in a triangular shape in a side view and has a vehicle body frame 105" having no opening 112*a* and having the down frames 112 connected to the front end portions of the cylinder portion 30.

As described above, the motorcycle 101" according to the third embodiment includes the cowl side portion 122*a* (cowling 122) that covers the portion extending from the side of the radiator 115 to the side of the engine 1". Further, the air flow path K2 is formed, and the spool valve 81 is disposed, inside the cowl side portion 122*a*. Accordingly, the same effects as those of the second embodiment can be achieved.

The present invention is not limited to the above-described embodiments. For example, the spool valve 81 (oil control valve) may be disposed sideways of the cylinder main body 30*a* or the head cover 3 as long as the spool valve 81 is disposed sideways of the cylinder portion 30.

The hydraulically-actuated mechanism of the engine 1, 1" may be, for example, an auto clutch mechanism or an automatic transmission system, in addition to the variable valve actuating mechanism 5.

The arrangements of the first to third embodiments described above are only typical and applicable to not only the motorcycle, but also a three-wheeled (one front wheel with two rear wheels, and two front wheels with one rear wheel) or a four-wheeled small-sized vehicle (a saddle-riding type vehicle) or a scooter type vehicle. It should be understood that various changes in form and detail may be made therein without departing from the spirit and scope of the invention.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. A vehicle, comprising:

an engine including a cylinder and a cylinder head;

a radiator disposed forward of said engine;

a down frame that extends vertically at a position to a side of said cylinder, in the vehicle width direction, to support said engine; and an oil control valve which adjusts hydraulic pressure of a hydraulically-actuated mechanism of said engine, wherein said oil control valve is disposed at a side of said cylinder or said cylinder head of said engine, in a vehicle width direction, an axis of said oil control valve extends substantially in parallel with an axis of said cylinder, said oil control valve is disposed rearward of said radiator, said oil control valve is disposed within a vertical span of said radiator, in a vehicle side view, and at least a part of said the oil control valve is disposed between said down frame and said radiator in the vehicle side view.

2. The vehicle according to claim wherein said oil control valve is disposed between said radiator and said engine.

3. The vehicle according to claim 2, wherein at least part of said oil control valve extends outwardly of said radiator in the vehicle width direction, in a vehicle front view.

4. The vehicle according, to claim 3, further comprising a cover member which extends from a side of said radiator to a side of said engine, wherein an air flow path is formed inside said cover member, and wherein said oil control valve is disposed inside said cover member.

5. The vehicle according to claim 2, further comprising a cover member which extends from a side of said radiator to a side of said engine, wherein an air flow path is formed inside said cover member, and wherein said oil control valve is disposed inside said cover member.

6. The vehicle according to claim 1, wherein at least part of said oil control valve extends outwardly of said radiator in the vehicle width direction, in a vehicle front view.

7. The vehicle according to claim 6, further comprising a cover member which extends from a side of said radiator to a side of said engine, wherein an air flow path is formed inside said cover member, and wherein said oil control valve is disposed inside said cover member.

8. The vehicle according to claim 1, further comprising a cover member which extends from a side of said radiator to a side of said engine, wherein an air flow path is formed inside said cover member, and wherein said oil control valve is disposed inside said cover member.

* * * * *